United States Patent [19]

Poppel et al.

[11] 4,422,879

[45] Dec. 27, 1983

[54] PAPER SIZING AGENT AND PROCESS FOR THE PREPARATION THEREOF

[75] Inventors: Guenter Poppel; Horst Schuermann, both of Dueren; Gabriel Falkenberg, Vettweiss, all of Fed. Rep. of Germany

[73] Assignee: Akzona, Inc., Asheville, N.C.

[21] Appl. No.: 402,189

[22] Filed: Jul. 26, 1982

Related U.S. Application Data

[63] Continuation of Ser. No. 143,987, Apr. 28, 1980, abandoned.

[30] Foreign Application Priority Data

Apr. 28, 1979 [DE] Fed. Rep. of Germany ..... 2917439

[51] Int. Cl.[3] ..... C08L 93/04

[52] U.S. Cl. ..... 106/238; 252/108

[58] Field of Search ..... 106/238; 252/108

[56] References Cited

U.S. PATENT DOCUMENTS

| | | | |
|---|---|---|---|
| 1,970,578 | 8/1934 | Schoeller et al. | 8/127 |
| 3,034,910 | 5/1962 | Dean et al. | 106/165 |
| 3,671,461 | 6/1972 | Sheers et al. | 252/358 |
| 4,065,404 | 12/1977 | Satterwhite et al. | 252/358 |
| 4,199,369 | 4/1980 | Hughes et al. | 106/238 |

FOREIGN PATENT DOCUMENTS

| | | |
|---|---|---|
| 1131348 | 6/1962 | Fed. Rep. of Germany . |
| 2627943 | 6/1976 | Fed. Rep. of Germany . |
| 1297374 | 11/1972 | United Kingdom . |
| 1547282 | 6/1979 | United Kingdom . |

OTHER PUBLICATIONS

*Chem. Abst.* 71:39,873, 1969, Striker.

Schoenfeldt, N., *Surface Active Ethylene Oxide Adducts,* Pegamon Press 1970, TP 994 S3, (Group 126), pp. 77, 78.

*Primary Examiner*—Theodore Morris

*Attorney, Agent, or Firm*—Frank W. Young; Robert F. Green

[57] ABSTRACT

An improved inversion process for the preparation of a paper sizing agent which is an aqueous dispersion containing a high content of free rosin in the form of fortified rosin and/or non-fortified rosin, water, and an anionic dispersing agent is disclosed. The improvement comprises using as the dispersing agent a polyethoxylated, sulfated rosin or a derivative thereof. There is also disclosed an aqueous dispersion useful as a paper sizing agent comprising from about 10 to about 60% of fortified and/or non-fortified rosin, from about 1 to about 10% of a polyethoxylated, sulfated rosin or a derivative thereof, based on the total weight of all solids in the dispersion, and a sufficient amount of water to form a dispersion.

12 Claims, No Drawings

PAPER SIZING AGENT AND PROCESS FOR THE PREPARATION THEREOF

This is a continuation of application Ser. No. 143,897, filed Apr. 28, 1980 now abandoned.

BACKGROUND OF THE INVENTION

This invention relates to a process for preparing a sizing agent for paper in the form of an aqueous dispersion with a high free rosin content, from resins based upon reinforced and/or non-fortified rosins and water, with the use of an anionic dispersing agent. This invention also relates to aqueous dispersions useful as paper sizing agents, and to their use in the sizing of paper.

Paper sizing agents based upon fortified rosin in the form of aqueous dispersions with a high free resin content have been known for a long period of time. For example, German Patent No. 1,131,438 describes aqueous dispersions containing fortified rosins, such as adducts of rosin and $\alpha,\beta$-unsaturated carbonyl compounds, such as fumaric acid, maleic acid, and the like. However, in order to achieve a certain stability in such dispersions, it has been necessary to add fatty acids and/or naphthenic acids in addition to the fortified rosin. Furthermore, the presence of a protective colloid, such as casein, is required as well. However, the concomitant use of casein is accompanied by several disadvantages. Primarily, casein is a valuable, expensive albumin product, and secondarily, dispersions made with the use of casein have only limited stability in storage and tend to show a precipitate after a certain storage time. Furthermore, the use of casein is accompanied by troublesome odors.

Various possibilities for the preparation of dispersions from free casein have been previously explored. In this respect, one may refer to German Pat. No. 1,958,965 which describes a process for the preparation of a fortified rosin sizing in accordance with which a solution is first made of the rosin based material and an organic solvent immiscible with water, which solution is then emulsified in water. After homogenizing, the organic solvent immiscible with water is, in essence, completely removed. The process is relatively complex and furthermore, working with organic solvents may pose potential health or environmental problems. Reclamation of the organic solvent is difficult and waste water contaminated with the organic solvents give rise to considerable ecological problems.

It has also been attempted to obtain stable dispersions of fortified rosin by using many various dispersing agents, such as salts of alkylaryl sulfonic acids, sulfonated higher fatty alcohols, sulfonated castor oil, resin soaps, and the like. Frequently, the use of these dispersing agents requires the concomitant use of additional protective colloids, such as casein, and special processing methods are often required to obtain a dispersion with a fine distribution. In addition, the resulting dispersions often have a stability of short duration and cannot be stored for any length of time. Besides numerous compounds with the sulfo substituents derived from succinic acid, German Pat. No. 2,627,943 also discloses compounds with are ethylene oxide adducts. Thus, the compound which is used to form the dispersion is obtained when a maleate is used as an initial material that has been esterified with an ethylene oxide adduct of an alkanol with at least 6 carbon atoms.

Although a large number of paper sizing agents in the form of aqueous dispersions containing high free resin content derived from rosin based material are already known, there still exists a need for a paper sizing agent of this type with improved characteristics which can be obtained through simple processing, while demonstrating suitable economic benefits.

An object of the present invention is therefore to make available a process, according to which the economic preparation of such dispersions will be possible in a simple manner, which process will also lead to dispersions having excellent stability, suitable for surface sizing, as well as internal sizing.

It is also an object of the present invention to make available a process by which dispersions may be prepared that can be stored for an extended period of time and that contain a high concentration of solid substances based upon rosin, leading to paper with a high degree of sizing that can be processed without difficulty.

A further object of the present invention is to make available sizing agents for paper that are compatible with the usual additives employed in the sizing of paper.

SUMMARY OF THE INVENTION

The foregoing objects and others are solved by providing an improved inversion process for the preparation of a paper sizing agent which is an aqueous dispersion containing a high content of free rosin in the form of fortified rosin and/or non-fortified rosin, water, and an anionic dispersing agent. The improved process comprises using as the dispersing agent a polyethoxylated, sulfated resin, or a derivative thereof.

The present invention also provides an aqueous dispersion useful as a paper sizing agent comprising from about 10 to about 60% of fortified and/or non-fortified rosin, from about 1 to about 10% of a dispersing agent which is a polyethoxylated, sulfated rosin, or a derivative thereof, based on the total weight of all solids in the dispersion, and a sufficient amount of water to form a dispersion.

If desired, other additives such as extenders may be included in the aqueous dispersions.

DETAILED DESCRIPTION OF THE PREFERRED EMBODIMENTS

In the practice of the present invention either fortified or non-fortified rosin may be utilized. It is preferable to utilize rosin which has been fortified with maleic acid, maleic anhydride, fumaric acid, or itaconic acid.

The rosin based material, which is utilized either fortified or non-fortified, is any commercial rosin, such as wood rosin, gum rosin, tall oil rosin, and the like, as well as partly or substantially completely hydrated rosin, and polymerized, as well as disproportionated rosin. Within the frame-work of the present invention rosin based material also refers to rosin material which has been obtained chemically, as by the transformatin of formaldehyde, acetic anhydride, and the like.

The dispersing agents which are useful for the preparation of the dispersions of the instant invention are polyethoxylated, sulfated rosin. The dispersing agents may also be present in the form of derivatives such as their salts, having, for example alkali metal ions, ammonium, or amines functioning as the cation. Also the rosins may have been fortified with any known fortified agent.

The dispersions of the present invention may be prepared according to the inversion method. However, the dispersant may also be added directly to the fortified or non-fortified rosin, or to the rosin mixture, without prior dilution.

As indicated, the paper sizing agent of the present invention comprises from about 10 to about 60%, preferably from about 20 to about 40%, by weight, of fortified and/or non-fortified rosin, water, and from about 1 to about 10%, preferably from about 3 to about 6%, by weight, of a polyethoxylated, sulfated material derived from rosin. Optionally, other additives such as extenders may be present. The sizing agents pursuant to the present invention are especially well suited for the sizing of paper.

As utilized herein, the expression high free rosin content designates that at least about 80%, preferably at least about 90%, of the rosin material is present as free rosin. For the preparation of the fortified rosin, use may be made of $\alpha,\beta$-unsaturated aliphatic carboxylic acids and their anhydrides, such as fumaric acid, maleic acid, acrylic acid, itaconic acid, citraconic acid, maleic anhydride, itaconic anhydride, and citraconic anhydride. It is also possible to use acid mixtures of the aforementioned compounds for the preparation of the fortified rosin. If desired, it is also possible to use mixtures of different fortified rosins.

The extenders which are useful in the present invention include any customary extender, such as waxes, petroleum rosins, terpene rosins, and the like.

The dispersing agents which are useful in the practice of the present invention may be prepared in the following manner. First, an adduct is prepared in a typical manner as by adding ethylene oxide to a normal rosin, may be fortified or non-fortified. Depending upon the reaction conditions and the chosen initial compound, a product having a varying degree of ethoxylation may result. Preferably, the degree of ethoxylation will be such that the final sulfated dispersing agent contains from about 35 to about 70%, by weight, of ethylene oxide, based on the total weight of the dispersing agent. The preparation of the rosin adducts is described in N. Schoenfeldt, Surface active Ethylene Oxide Adducts, page 77.

To convert the ethylene oxide adduct to a corresponding sulfate, the adduct may be reacted with a slight stoichiometric excess, preferably about 1 mole of adduct per about 1.1 mole of amidosulfonic acid. By means of a salt exchange, compounds with other cations, such as sodium and potassium may be prepared in a known manner.

The dispersions which are useful in the present invention may be prepared according to the known inversion method. In such a process, for example, the rosin is first melted and a small quantity of dispersing agent is added thereto, so that a water-in-oil dispersion is formed. Additional hot water is then added (water of inversion) accompanied by vigorous stirring, until a rosin-in-water emulsion is formed. The rosin solidifies during cooling, resulting in an aqueous dispersion of very finely distributed rosin particles.

The dispersions of the present invention may also be prepared with the use of an organic auxiliary solvent, such as benzene. After homogenizing, the benzene may again be removed in a substantially quantitative manner.

It is especially surprising that the process of the present invention results in the formation of very stable, aqueous dispersions with a high content of free rosin, in which the rosin is present in a very fine distribution. It is also surprising that the rosin does not display any substantial sedimentation phenomena after lengthy periods of storage. During sizing, the dispersions may also be processed without difficulty. Furthermore, the dispersions are compatible with most additives customarily employed in the manufacture of paper.

The present invention will be further described in the following non-limiting examples.

EXAMPLE 1

(Preparation of a fortified rosin based material)

930 g of balsamic rosin are melted with 70 g of fumaric acid and subsequently heated for 4 hours at 200° C. Subsequently, the fumaric acid is taken up completely.

EXAMPLE 2

(Preparation of a rosin ethylene oxide adduct)

300 g of balsamic rosin, together with 0.3% aqueous potassium lye are placed in an autoclave, which is flushed with nitrogen and subsequently freed from water at 120° to 130° C. Then, 440 g of ethylene oxide are added in batches with stirring, at 160° C., during which the pressure should not rise above 5 bar. After the entire quantity of ethylene oxide has been added, the reaction mixture is heated for another hour at this temperature.

EXAMPLE 3

300 g of a fortified rosin based material prepared according to Example 1 are reacted with 529 g of ethylene oxide in the same manner as in Example 2.

EXAMPLE 4

400 g of a rosin-acid ethylene oxide adduct prepared according to Example 2 are heated to 120° C. and 96 g of amidosulfonic acid added thereto in batches, during which care is taken, that the temperature does not exceed 120° C. This process takes about 1.5 hours, after which the reaction is allowed to continue for another 1.5 hours at 120° C., followed by cooling to 70° to 80° C. and neutralizing with monoethanolamine, until the pH value of a 10% aqueous solution is between 7 and 8. The corresponding potassium salt is prepared by means of a salt exchange with KOH.

EXAMPLE 5

328 g of a fortified rosinic acid ethylene oxide adduct prepared according to Example 3 are heated to 120° C. and 96 g of amidosulfonic acid added thereto in batches, during which care is taken that the temperature will not exceed 120° C. Further processing proceeds analogous to Example 4. In this process not all reactive groups are converted to the sulfate.

EXAMPLE 6

(Preparation of a rosin emulsion free from casein)

800 g of a rosin fortified with fumaric acid (prepared according to Example 1) are melted and, at 120° C., 4% of a dispersing agent according to Example 4 added thereto. (The dispersing agent can also be first dissolved in water. In this case, metering-in has to be performed slowly, since otherwise the escaped steam will cause too much development of foam.) When the rosin/dispersing agent mixture has reached a temperature of about 100° C., water is slowly added with simultaneous, vigorous stirring. The temperature of the added water is about 80° to 90° C. After the addition of about 400 ml of water, a highly viscous water-in-oil emulsion has been formed which, after more water is added, will turn into an oil-in-water emulsion. Approximately another 800 ml of water are then added, as a result of which a 40% emulsion is formed. During cooling, the emulsion is converted into a dispersion, the particles of which have an average size of 0.2 to 0.5 micron. The dispersion can be stored for an extended period of time (at least 3 months), without the occurrence of a sediment.

EXAMPLE 7 TO 10

In the following examples, the sizing agents pursuant to the invention are used for the sizing of paper with 0.75% abs.-dry application of size in an acid and neutral pH range, and compared with resin emulsions prepared with the addition of casein. The results of the sizing agent pursuant to the invention results in better Cobb values and, so far as ink and reflectance are concerned, at least in equally good data as resin emulsions with casein.

In all examples, the composition of the pulp was 50% pine sulfate, 25% birch sulfate and 25% beech sulfate. The degree of beating was 24° SR.

In Examples 7 and 8 the pH was set at 4.5 with alum, in Examples 9 and 10 it was adjusted to 6.5 with Na aluminate, or alum, respectively. In Examples 9 and 10, 0.04% by weight of Etadurin N76 was used in addition (Etadurin is a polyamidoamino-epichlorohydrin resin, which is used as wet strength agent, or retention agent). The following measuring methods were used:

1. Degree of sizing vs. ink, with the Hercules Sizing Tester, in keeping with the operating instructions of the manufacturer, Hercules, Inc., Wilmington, Del. The time is measured in seconds which elapses until the reflectance value of the paper drops to 80% when the testing ink has been applied to the paper and penetrates it.
2. Cobb test (DIN standard 53/32-1 minute)
   a. Absorptivity vs. water, expressed in grams of water uptake per $m^2$ after 1 minute of contact with water.
   b. Absorptivity vs. a 10% $Na_2CC_3$ solution, expressed in grams of uptake per $m^2$ after a contact of 1 minute, as under 2.a. Additional details regarding the measuring methods can be found in the above-mentioned book by Engelhardt and others (see page 12).

TABLE

| Example | Dispersing Agent | Cobb O.S. | Cobb S.S. | Ink O.S. | 80% reflectance S.S. |
|---|---|---|---|---|---|
| 7 | 4 | 17 | 16 | 190 | 320 |
| 8 | 5 | 18 | 19 | 180 | 290 |
| resin emulsion with casein | | 19 | 21 | 150 | 220 |
| 9 | 4 | 16 | 16 | 620 | 820 |
| 10 | 5 | 15 | 16 | 740 | 868 |

What is claimed is:

1. In an improved inversion process for the preparation of a paper sizing agent which is an aqueous dispersion containing a high content of free rosin in the form of fortified rosin and/or non-fortified rosin, water, and an anionic dispersing agent, the improvement comprising using as the dispersing agent a polyethoxylated, sulfated rosin, or a derivative thereof, in an amount from about 1 to about 10%, based on the total weight of all solids in the dispersion.

2. The process of claim 1 wherein the polyethoxylated sulfated rosin or derivative thereof is fortified with a fortifying agent based upon an $\alpha,\beta$ unsaturated, aliphatic carboxylic acid or its anhydride.

3. The process of claim 1 wherein the polyethoxylated sulfated rosin is present in the form of a salt.

4. The process of claim 2, or 3 wherein the polyethoxylated sulfated rosin contains from about 35 to about 70 percent, by weight, of ethylene oxide, based upon the total weight of the dispersing agent.

5. The process of claim 1 wherein the paper sizing agent also contains one or more extenders.

6. The process of claim 4 wherein the paper sizing agent also contains one or more extenders.

7. The process of claim 1, 2, or 3 wherein the dispersing agent is prepared by reacting a rosin ethylene oxide adduct with amidosulfonic acid.

8. An aqueous dispersion useful as a paper sizing agent comprising from about 10 to about 60% of fortified and/or non-fortified rosin, from about 1 to about 10% of a dispersing agent which is a polyethoxylated, sulfated rosin, or a derivative thereof, based on the total weight of all solids in the dispersion, and a sufficient amount of water to form a dispersion.

9. The dispersion of claim 8 which also contains one or more extenders.

10. The dispersion of claim 8 or 9 wherein the reinforced or non-reinforced rosin is present in an amount from about 20 to about 40 percent and the dispersing agent is present in an amount from about 3 to about 6 percent, by weight, based on the total weight of all solids in the dispersion.

11. The process of claim 1 wherein the dispersing agent is used in an amount from about 6 to about 10%.

12. The process of claim 1 wherein the dispersing agent is used in an amount from about 4 to about 11%.

* * * * *